United States Patent [19]

Carlson

[11] Patent Number: 4,567,705

[45] Date of Patent: Feb. 4, 1986

[54] FIRE PROTECTION ARRANGEMENT AND METHOD OF POSITIONING SAME

[75] Inventor: James P. Carlson, Pinehurst, Tex.

[73] Assignee: Avco Corporation, Lowell, Mass.

[21] Appl. No.: 443,470

[22] Filed: Nov. 22, 1982

[51] Int. Cl.[4] ..... E04B 2/26; E04C 1/06; E04C 3/30

[52] U.S. Cl. ..... 52/405; 52/576; 52/309.17; 52/596; 52/727

[58] Field of Search ..... 52/596, 405, 727, 309.4, 52/309.12, 309.17, 576, 606, 577

[56] References Cited

U.S. PATENT DOCUMENTS

| | | | |
|---|---|---|---|
| 1,787,453 | 1/1931 | Murray | 52/577 |
| 3,388,509 | 6/1968 | Mora | 52/606 |
| 3,597,890 | 8/1971 | Hala | 52/577 |
| 3,653,170 | 4/1972 | Sheckler | 52/309.12 |
| 3,908,327 | 9/1975 | Quigg | 52/727 |
| 3,922,413 | 11/1975 | Reineman | 52/576 |
| 3,979,870 | 9/1976 | Moore | 52/577 |
| 3,998,028 | 12/1976 | Pelletier et al. | 52/727 |
| 4,002,002 | 1/1977 | Barnhardt | 52/405 X |
| 4,027,445 | 6/1977 | Nickerson | 52/405 |
| 4,123,881 | 11/1978 | Muse | 52/309.12 X |
| 4,285,179 | 8/1981 | Goidinger | 52/309.12 |
| 4,295,810 | 10/1981 | Dennert et al. | 52/405 X |
| 4,306,395 | 12/1981 | Carpenter | 52/309.12 X |
| 4,324,080 | 4/1982 | Mullins | 52/405 X |

FOREIGN PATENT DOCUMENTS

| | | | |
|---|---|---|---|
| 813200 | 9/1951 | Fed. Rep. of Germany | 52/576 |
| 1186867 | 4/1970 | United Kingdom | 52/727 |
| 1413016 | 11/1975 | United Kingdom | 52/727 |
| 554367 | 5/1977 | U.S.S.R. | 52/727 |

OTHER PUBLICATIONS

The Insulators Estimating Handbook, published by Frank R. Walker Co., 5030 North Harlam, Avenue, Chicago, Ill., 60656, pp. 31, 33 and 35.

*Primary Examiner*—J. Karl Bell

*Attorney, Agent, or Firm*—Abraham Ogman

[57] ABSTRACT

A cementitious panel is provided with spaced inner and outer surfaces connected by edge surfaces. A waterproof film forms longitudinally extending cavities within the panel, with the cavities being laterally spaced from each other and spaced from the inner, outer and edge surfaces of the panel. Expanded lightweight, inert granular material substantially fills the cavities, and a suitable film closes off the ends of the cavities.

When necessary or desirable, the panels are temporarily secured in position adjacent a member and in end to end relation to enclose it and provide fire protection. Holes are drilled through the panels at predetermined locations, and metal studs are inserted through the panel to contact the enclosed metal member and the stud is the welded to the member so that the end of the stud projects outwardly beyond the panel surface. The panels are then secured to the stud end projecting therethrough to enclose and provide fire protection to the member within the positioned panels.

19 Claims, 21 Drawing Figures

FIRE PROTECTION ARRANGEMENT AND METHOD OF POSITIONING SAME

SUMMARY OF THE INVENTION

Various types of materials and means have been proposed and used in an endeavor to provide fire protection to metal members such as structural columns and beams of a building, offshore drilling structures, storage tanks, vehicle tank and railroad tank car vehicles used for transporting combustible substances and various types of installations in petrochemical, refining and other types of industries. Indeed, efforts have been made in the past and are continually underway to provide fire protection in any situation or arrangement where necessary. Some of such arrangements have employed panels of various types of substances formed by precasting or in other ways and have also employed substances that can be sprayed on or otherwise arranged relative to the member to be protected.

One of the most common forms of endeavoring to provide suitable fire protection in buildings where metal columns and beams are employed is to encase the metal structural members in concrete. However, such procedure is costly and time consuming, not only in initially installing the necessary forms to receive the cement around the structural members to be protected and thereafter removing the forms, but the resulting mass of concrete substantially increases the weight of the structure and hence adds substantially to the cost of construction. Additionally, such method cannot be employed in many situations such as vehicles that are moved over ordinary roads due to the substantial additional weight of a concrete coating, and in many other installations, it is desirable to gain access to the member which is being protected from time to time, and when encased in concrete, such access is restricted, if not substantially prevented.

A primary object of the present invention is to provide a fireproofing arrangement and method of securing it in position which overcomes the above and other disadvantages of fire protection panels and arrangements heretofore employed.

Other objects and advantages of the present invention will become more readily apparent from a consideration of the following drawings and description.

BRIEF DESCRIPTION OF THE DRAWINGS

FIG. 19 illustrates the arrangement of the present invention when employed on a vessel skirt or the like;

BRIEF DESCRIPTION OF THE PREFERRED EMBODIMENT

Attention is first directed to FIGS. 1-5 of the drawings wherein the cementitious panel of the present invention is referred to generally by the letter P. Any suitable mixture of cement and silica may generally be employed to form the panel P of the present invention depending upon the fire proofing environment in which the panel P is to be employed. One suitable composition for forming the panel may comprise the following constituents:

| | Approximate Percentage Range by Weight |
|---|---|
| Great Portland Cement or Calcium Aluminate Cement | 45-65 |
| Expanded Perlite or Vermiculite | 10-20 |
| Silica Passing No. 3 Mesh | 10-20 |
| Silica Passing No. 4 Mesh | 10-20 |
| Alkali Resistant Glass Fibers | .5-1.5 |
| Total | 100 |

The form of the cast may vary depending upon the configuration of the member with which the panels P are to be employed for fireproofing, and as illustrated in FIGS. 1-5, inclusive, the panel P is shown as being generally rectangular in configuration and having spaced inner and outer walls 25 and 26, respectively, as well as side edge surfaces 27 and 28 and bottom and top edge surfaces 29 and 30, respectively.

Before all the concrete is poured into the molds for forming the panels P, suitable film means referred to generally by the letter F are positioned in the mold to form longitudinally extending cavities C which are laterally spaced relative to each other and relative to the inner and outer surfaces 25, 26 and the edge surfaces 27, 28, 29 and 30 as generally illustrated in FIGS. 1-5 of the drawings. The substance forming the film means F is illustrated as not only extending longitudinally, but is shown as being generally cylindrical in configuration. The configuration of the cavities C is not critical, although I have discovered that the cylindrical configuration provides satisfactory results.

Figure 17:
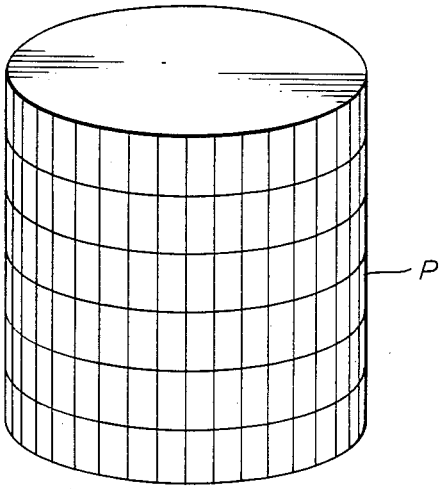
FIG. 17 illustrates the use of the panel of the present invention for a cylindrical tank.

It can be appreciated that where the panel P assumes other configurations, such as that illustrated in FIG. 17, to provide fire protection for members having other types of configurations, such as round or any other configuration, the film means F will be formed to generally conform with the final configuration of the panel means P and still remain spaced relative to the surfaces of the panel means P as generally shown in FIGS. 1–5 of the drawings.

The film means F may comprise any suitable material such as plastic, paper or the like and is waterproof, at least during the initial setting of the cement to form the panel P so that there is no passage of water between the panel P and the cavity C. The substance forming the film means F, if formed of paper, may comprise two or three layers of helically wrapped paper, with the outer layer being treated in any suitable manner to provide the necessary waterproofing. One suitable material that may be used as the outer wrap is a wax paper sold under the trademark Glassine; however, any suitable waterproof paper may be employed.

Figure 9:
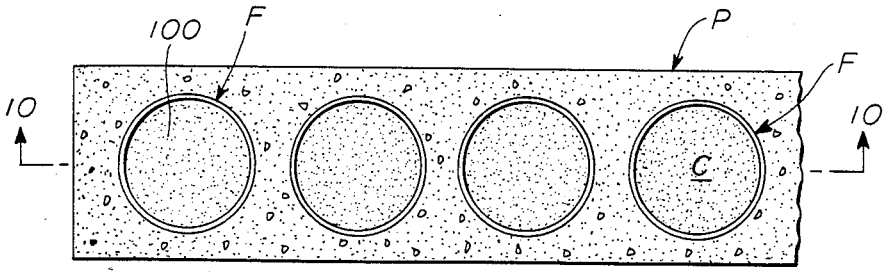
FIG. 9 is a sectional view illustrating the panel of the present invention when employed as an architectural panel.
Figure 10:
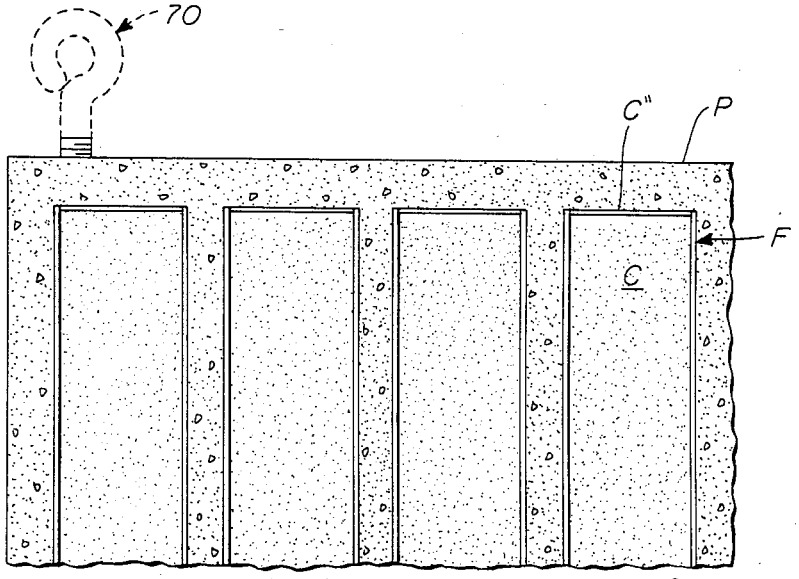
FIG. 10 is a sectional view on the line 10—10 of FIG. 9 illustrating further details.

The thickness of the film means F will vary in the range of approximately 15 to 80 mils, depending upon the thickness of the panel P. For example, where the panel P is to be employed with a structural member such as a column or beam as represented generally in FIGS. 1 and 2 of the drawings, I have discovered that a film thickness of approximately 18 to 25 mils functions quite satisfactorily in larger architectural panels such as illustrated in FIGS. 9 and 10, the film F is substantially larger in size. For example, the panels P when employed as architectural panels, may be in sizes of approximately 4′ wide and 8 or 9′ long, and in some instances, the architectural panels may be even larger. Such architectural panels may be of any thickness such as 4″ thick and 2½′0 wide, and in this instance, the film means F forming the tubular cavities C may be 95″ long or longer and approximately 2½″ in diameter or larger. When the film means F reaches these sizes, I have discovered that it is desirable to provide a reinforcing mesh of glass strand or other suitable reinforcing as the outer layer to provide strength to the tube formed by the film means during the formation of the panel P. The fiberglass mesh may be applied adjacent the outer waterproof layer and secured thereto by any suitable means such as glue or the like.

Figure 1:
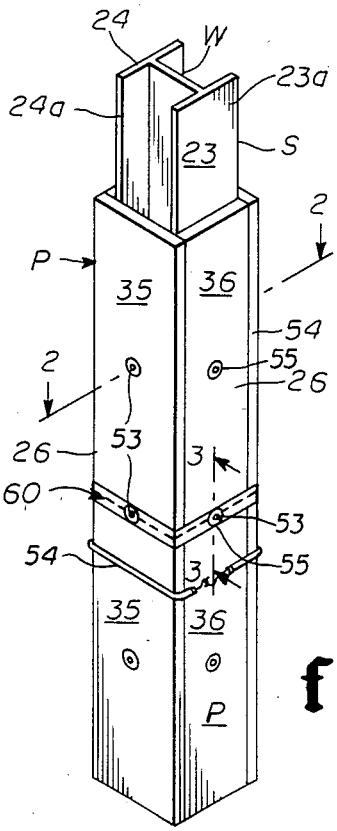
FIG. 1 is an elevational view showing a form of the panel means of the present invention positioned on a column.
Figure 2:
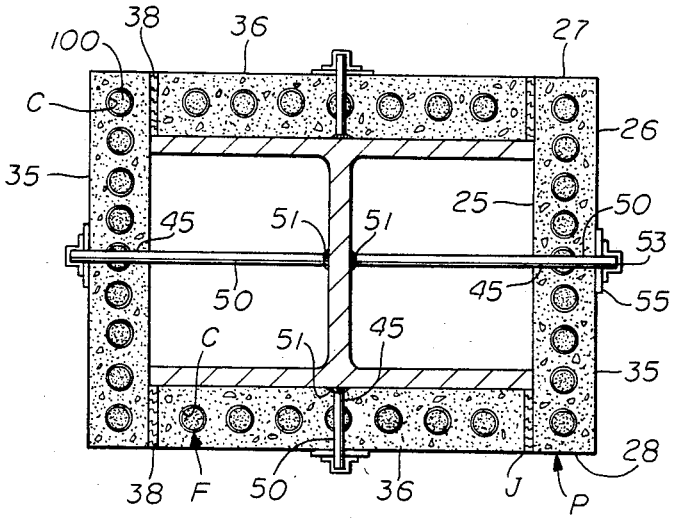
FIG. 2 is a sectional view on the line 2—2 of FIG. 1 illustrating further details of the present invention.
Figure 3:
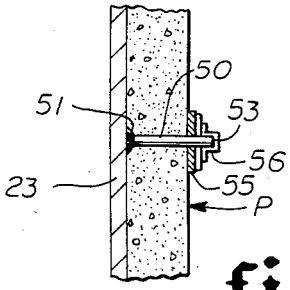
FIG. 3 is a partial sectional view on the line 3—3 of FIG. 1 illustrating further details of a means of securing the panel of the present invention in position on a member.
Figure 4:
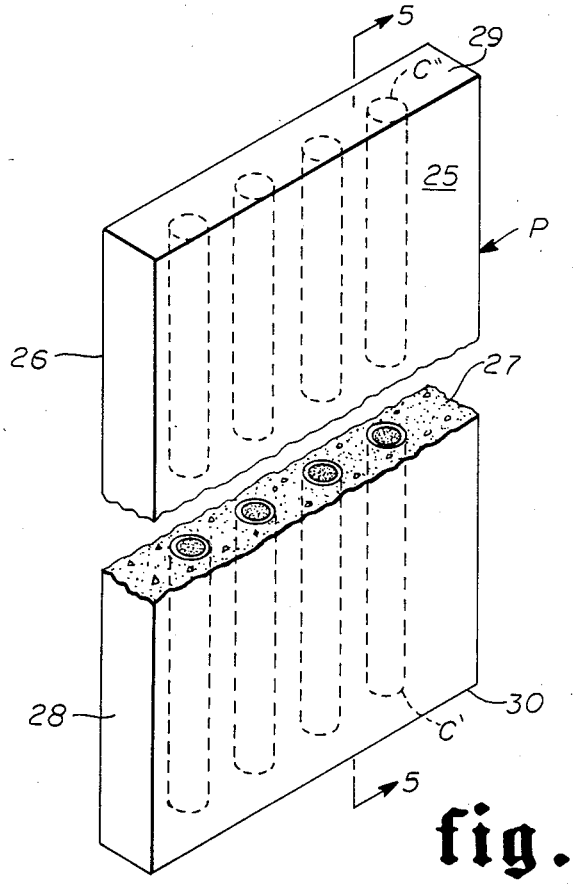
FIG. 4 is a perspective view illustrating further structural details of the panel of the present invention.
Figure 5:
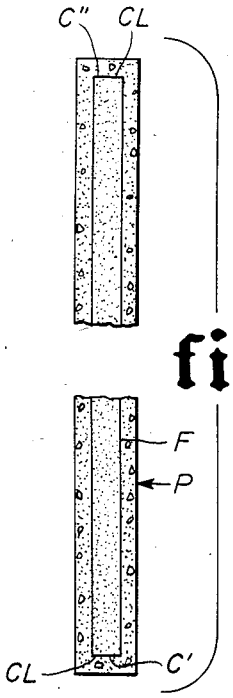
FIG. 5 is a sectional view on the line 5—5 of FIG. 4 to illustrate further structural details of the present invention.

Additionally, The film thickness of the larger architectural panels may be within the range of approximately 40 to 80 mils in thickness, whereas the film thickness for smaller panels used for structural members such as illustrated in FIGS. 1 and 2 is preferably within the range previously given hereinabove.

The thickness of the cementitious panel P when employed with a structural member, such as 10W49×10′ long, as illustrated in FIGS. 1 and 2 of the drawings has, by way of example only, is preferably approximately 1⅛″ to approximately 2⅛″ in thickness and approximately 2½″ long. The weight of the cementitious panel preferably in such instance is within the range of approximately 12 to 40 pounds, depending upon its size. The size and weight are not critical, except that the panels are preferably of a size to enable them to be readily manually handled, carried and readily positioned on the member to be fire protected in a manner as will be described hereinafter.

The lower end C′ of the cavity C formed by film means F is closed or sealed off, and the upper end C″ of the cavity C formed by the film means F is also closed or sealed off. The closure means for the ends C′ and C″ may be the film F or other suitable film means such as sodium silicate which may be sprayed on the open ends of the tubes formed by the film F. The end film or closure is represented by the letters CL. However, before closing off the tubes or cavities C formed by the film means F, such cavities are filled with expanded inert, lightweight granular material such as perlite or vermiculite as referred to generally by the numeral 100. Perlite is the preferred expanded material which may be employed. Also, I have discovered that the film means F may be preferably positioned within the panel P so that the lateral spacing between the cavities C is approximately ⅜″ in a panel P of the general size referred to above for fireproofing structural members, and generally the lateral spacing from the surfaces 25, 26, 27, 28, 29 and 30 is also approximately ⅜″, but this may vary depending upon the use to which the panel is to be employed.

Figure 7:
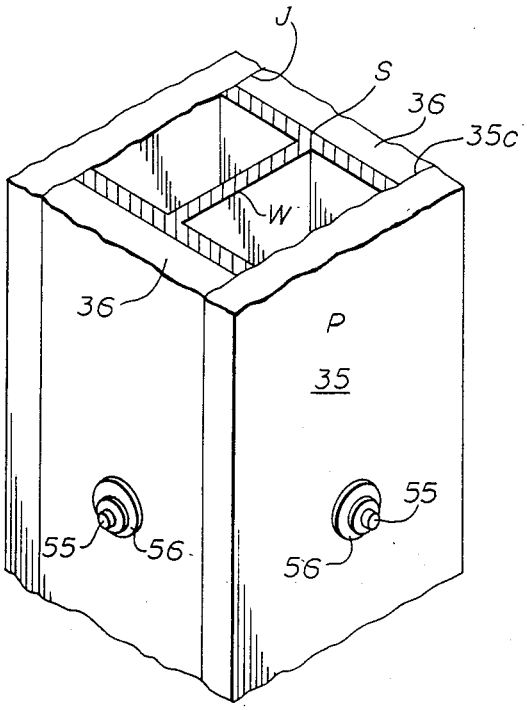
FIG. 7 is a perspective view partly in section illustrating the arrangement of the present invention on a horizontal beam structural member.

As a practical matter, the film means F is formed into tubes where the shape is cylindrical, filled with the inert, lightweight granular material and the ends C′ and C″ then sealed or closed and the tubes then positioned in the mold prior to pouring the cement mixture into the mold.

Where the panels P are to be employed to enclose structural members such as the vertical column referred to by the letter S in FIG. 1, or a horizontal beam as represented by FIG. 7, they will be configured to overlap each other when positioned so as to fully enclose the structural member S, whether it is a beam or column. For example, it will be noted that the vertical structural member S of FIG. 1 has a web W extending between the flanges 23 and 24 of the member S as designated in FIG. 1. The panel means P designated at 35 extends parallel to the web W, and the panel means 36 extend prallel to the flanges 23, 24. The width of the panels 35 parallel with the web or approximately the distance between the outer surfaces 23*a* and 24*a* of the flanges 23 and 24, respectively, plus two times the thickness of the panel 36 which is parallel with the flange 23. The width of the panels 36 parallel to the flanges 23 and 24 are approximately the width of the column flange 23 or 24 adjacent thereto. In some instances, the width of the panels 36 parallel with the flanges 23, 24 is at least approximately ¼″ less than the width of the flange to form a clearance 38 between the panels 36 and the overlapping or overlying portion of the panels 35 that are parallel to the web W.

If the panels 35 and 36 are in substantial close fitting relationship, any suitable flexible caulking compound may be applied to the adjacent edges to seal off therebetween. If there is a clearance such as that illustrated at 38 between the panels 35, 36, any suitable fire resistant sealant may be employed in such clearance such as by way of example spun ceramic fiber sold under the designation Kaowool manufactured by Babcock & Wilcox Co. of Augusta, Ga. This substance is provided in roll form so that it can be readily positioned in the clearance 38, or stapled to the panel P before positioning on the structural member S.

The total volume of the lightweight expanded inert granular material or aggregate in all of the cavities C in each of the panels P, whether it is a panel for enclosing or covering a metal member, or whether it is non-load bearing architectural panel as illustrated in FIGS. 9 and 10, is within the range of approximately 25% to 45% of the total volume of the cementitious panel P. The preferred range of the total range of the cavities C is in the range of approximately 25% to approximately 38% of the total volume of the cementitious panel P.

Where the panels P are to be employed as a fire protection arrangement for a structural member such as a vertical column or horizontal beam in a building, they may be positioned so as to surround such structural member as illustrated in FIGS. 1 and 2 of the drawings. Similarly, where the panels are to be employed on a cylindrical or spherical tank, pipeline or in any other situation in which it is desired to provide fire protection, they may be positioned to enclose or surround such metal member, and secured in such position.

If the metal member with which the panels are to be secured has rust or mill scale thereon, the rust or mill scale should be removed by grinding or other suitable means to provide a clean surface so that the ends 51 of the metal pins or studs 50 may be secured therewith, preferably by welding. In some instances, the metal member may be provided with a protective coating, in which event the stud 50 will be welded therewith without removing such protective coating, or if necessary, the protective coating ground off before the stud is welded thereto.

The panels P are first positioned around the member to be protected by manually positioning them in end to end and edge to edge relationship as shown in the drawings. Thereafter, any suitable temporary retaining means such as a bungee cord or the like as illustrated at 54 in FIG. 1 may be employed and tied around the panels P and the member that they surround. Either before or after the panels P are in position on the member, holes 45 at predetermined locations are drilled therethrough by any suitable means. The holes 45 are positioned in the panels P so that when the stud 50 is inserted therethrough, the end 51 will contact the predetermined surface location that has been cleaned, where such cleaning is necessary. The metal stud or pin 50 is a capacitor discharge weld pin of any suitable well known type and may be either stainless steel or low carbon steel depending upon the circumstances in which the fire protection panel arrangement of the present invention is to be employed. A capacitor discharge stud welding apparatus may then be engaged with the stud, or the stud prepositioned in the capacitor weld gun and then inserted through the opening 45 in the panel to effect welding of the end 51 of the stud 50 at the predetermined clean location on the metal surface.

Thereafter, the panels P are secured in position on the stud 50 and to the member, such as the structural member S that they are to protect, to retain them in permanent position, and the temporary retainer cord 54 removed. The securing means preferably comprises a self-locking retainer ring or washer 55 which is manually inserted over the end 53 of the stud and pushed firmly against the surface 35 of the panels P through which the end 53 of the stud 50 projects. Thereafter, a self-locking closure and nut 56 is inserted over the end 53 of the stud end to retain the panel P on the stud 50 and adjacent the member it is to protect. Caulking compound may be applied to the joint between the adjacent panels to seal off therebetween. If there is a clearance as illustrated at J in FIG 2, the void may be filled with spun ceramic fiber, and caulking compound then applied at the joint over the fiber.

When the panels P are arranged to provide a fire protection arrangement for a vertical structural member such as S in FIG. 1 or a horizontal beam structural member as in FIG. 7, the holes 45 are formed in each panel so that the pins 50 may be inserted approximately midway longitudinally of each panel and at each panel joint as shown in the drawings. Where the structural member is a horizontal beam, or where the structural member is a vertical column in a traffic area, the joint between adjacent abutted panel edges is also preferably covered with a stainless steel band 60 to assist in retaining the panels in place. The stainless steel band 60 which, when used, is wrapped around the panels on the columns after the panels P have been temporarily positioned around the columns by the bungee cord 54 and before inserting the pins 50 through the holes 45 in the panels. The metal bands 60 may be frictionally secured in position by means well known. When the metal bands 60 are employed, holes may be punched into the band 60 after it has been positioned over the hole, or holes may be formed therein and then when the band in tightened and clamped in position, the holes align with the holes in the panel. Thereupon, the pins 50 may be inserted through the bands and panels and welded to the structural members S. Generally speaking, it will not be necessary to employ the metal bands 60 at all joints of the panels P on the vertical columns, but it may be desirable to use the bands on all panel joints on structural horizontal beams or other horizontal situations to assist in retaining them in place and supporting their weight.

Figure 6:
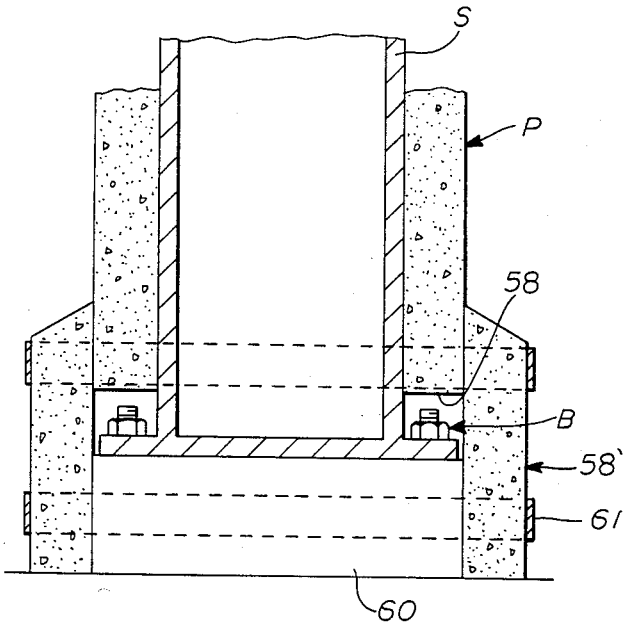
FIG. 6 illustrates one arrangement of the present invention on a structural metal member.

FIG. 6 illustrates the panel P of the present invention employed with a structural member S which forms a vertical column. The structural member S may be of the I-beam type or of any other suitable type. It will be noted that it is secured to the footing 60 by suitable means such as the nut and bolt arrangement referred to by the letter B. In this instance, the lower end 58 of the panel P may not readily receive the bolt and nut arrangement B, and in such instance, additional panels represented at 58′ surround the panels P as well as the footing 60 and are retained in position by metal strap means 61 wrapped therearound and crimped or buckled in position. This serves to close off or fireproof the footing as well as the nut and bolt arrangement at the lower end of the structural member S.

In FIG. 7, the panel arrangement is again illustrated where employed as a fire protection for a structural member such as a horizontal beam. However, in this arrangement the width of the panel member parallel to the flange is approximately the width of the flange so that it fits closely adjacent the overlying portion **35*c* of the panel 35 that is parallel to the web W. The joint J between these two members may be closed off by applying any ordinary flexible caulking compound along the joint. The panels 35 and 36 are positioned on the horizontal structural member by the pin 50, self-locking retainer ring 55 and self-locking nut and closure or cap 56 in a manner as previously described with regard to FIGS. 1 and 2**.

Figure 8:
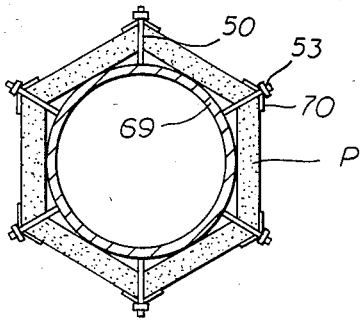
FIG. 8 is a sectional view illustating the present invention employed on a cylindrical member such as a pipeline or railroad tank car.

In FIG. 8, the panels P formed as disclosed herein are secured in edge to edge relation about the cylindrical member 69 by the longitudinally extending angle members 70, with pins 50 extending through members 70, and self-locking nuts 53 in a manner as described with regard to FIGS. 1–7.

FIGS. 9 and 10 represent panels P when employed as non-load bearing architectural panels. They are larger in size as previously noted, and may require mechanical means to lift and position them in place. To this end, a hook 70 may be secured in the panel P for ease in manipulation.

Figure 11:
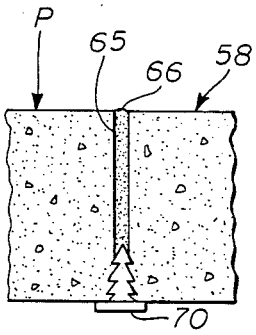
FIGS. 11, 12 and 13 are partial sectional views illustrating various edge configurations which may be employed for securing the panels of FIGS. 9 and 10 in edge to edge relation.
Figure 12:
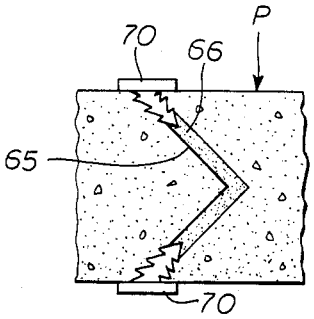
Figure 13:
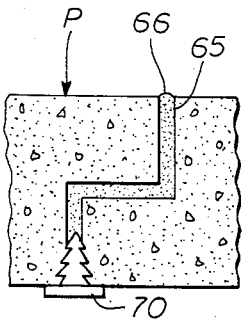

In FIGS. 11, 12 and 13 various suitable edge configurations are illustrated for the panels P where they are to be employed as architectural exterior panels. The joint represented at 65 between Panels P may be provided with any suitable caulking compound as illustrated at 66, and a sealing strip 70 inserted at the joint between the panels to engage adjacent panels and assist in sealing off any moisture. If desired, any other suitable form of retaining means and edge configuration could be employed to obtain the desired results.

Figure 14:
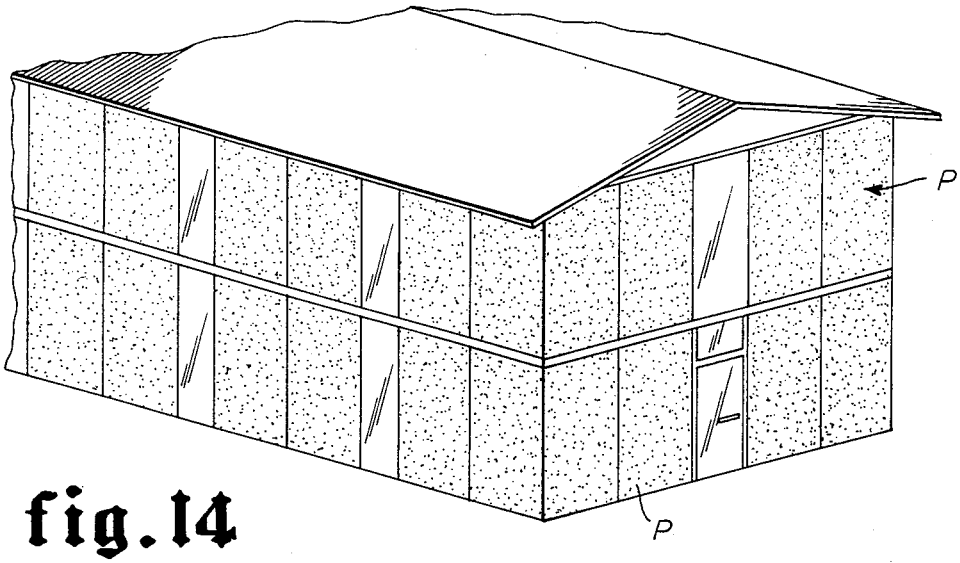
FIG. 14 illustrates the panel of the present invention employed as a nonload bearing architectural panel for a building.

FIG. 14 of the drawings illustrates the panels P of the present invention employed as the exterior wall of a building, and may be retained in position by any suitable means such as clips, support braces or the like well known to those skilled in the art.

Figure 15:
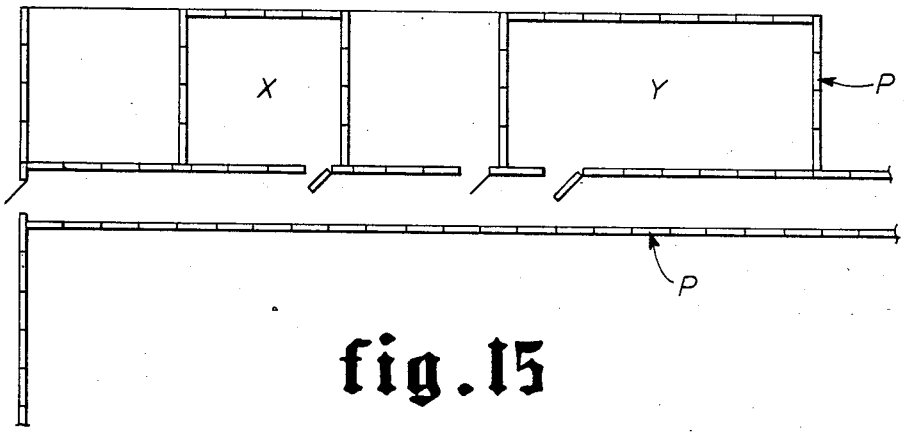
FIG. 15 is a view illustrating the use of the panel of the present invention for the interior walls of a building.

Similarly, in FIG. 15, the panels P are again illustrated as being employed as the interior wall of a structure where it is desired to provide walls of fireproof or fire resistant nature. The interior walls again may be retained in position by any suitable means well known to those skilled in the art.

Figure 16:
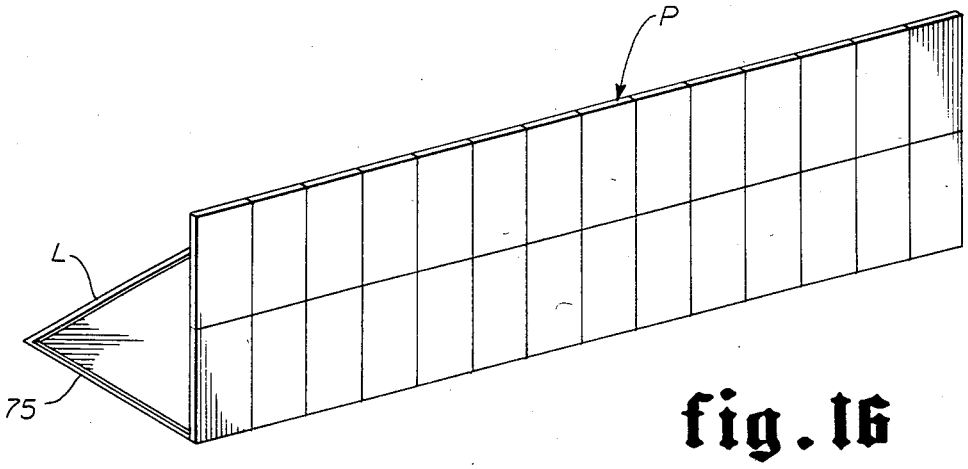
FIG. 16 illustrates the panel of the present invention employed as a firewall.

In FIG. 16, the panels P of the present invention are illustrated as being positioned and secured together to form a fire wall which may be employed in various industrial and other applications, such fire wall having suitable brace means 75 for enabling it to remain in vertical position as illustrated.

In FIG. 17, the panels P are illustrated as being positioned on a cylindrical tank, the manner of positioning and securing such panels P being that as described with regard to FIGS. 1, 2 and 6. The pins or studs 50 are again inserted in openings 45 in panels P and welded to the tank. The self-locking washer or retainer ring 55 and nut 53 are then placed on the pin 50 to hold each panel in position. Suitable caulking may be positioned along abutting panel edges.

Figure 18:
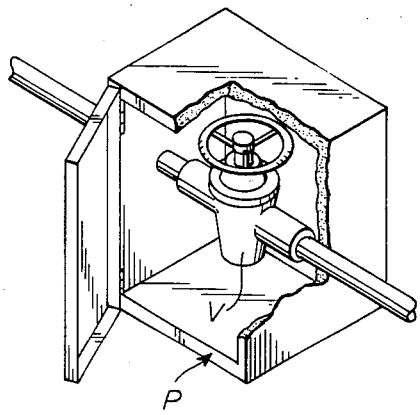
FIG. 18 illustrates the present invention employed as a valve housing.

In FIG. 18, the present invention is shown as utilizing a plurality of panel means P to form a housing or enclosure for a valve V to provide a fire protection or fire resistant arrangement with such valve V.

Figure 19:
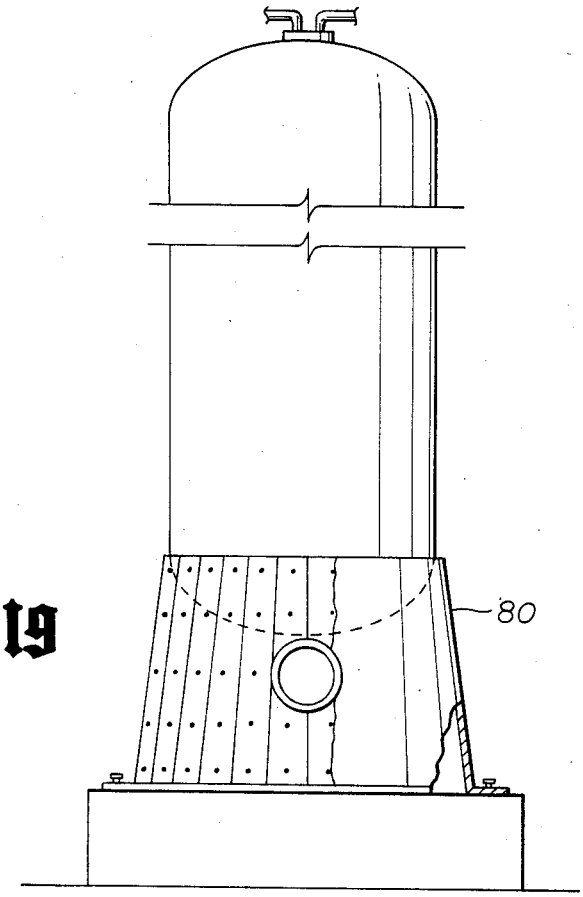
Figure 20:
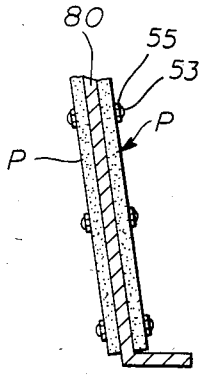
FIG. 20 is an enlarged partial sectional view of the vessel skirt of FIG. 19.

In FIGS. 19 and 20, panels P are shown as being positioned on the metal skirt 80 of a vessel to provide a fire resistant arrangement for the skirt 80 of the vessel. FIG. 20 shows the preferred manner of installing the panels P on the vessel skirt 80 in greater detail wherein panels P are installed on both the inner and outer surface of the vessel skirt. They are retained in such position by pins or studs 50 (not visible in FIG. 20) extending through holes 45 in the panel and the pins are welded to the skirt as described with regard to the prior drawing figures. Self-locking washers 55 and self-locking caps 53 are then installed on the pins as previously described.

Figure 21:
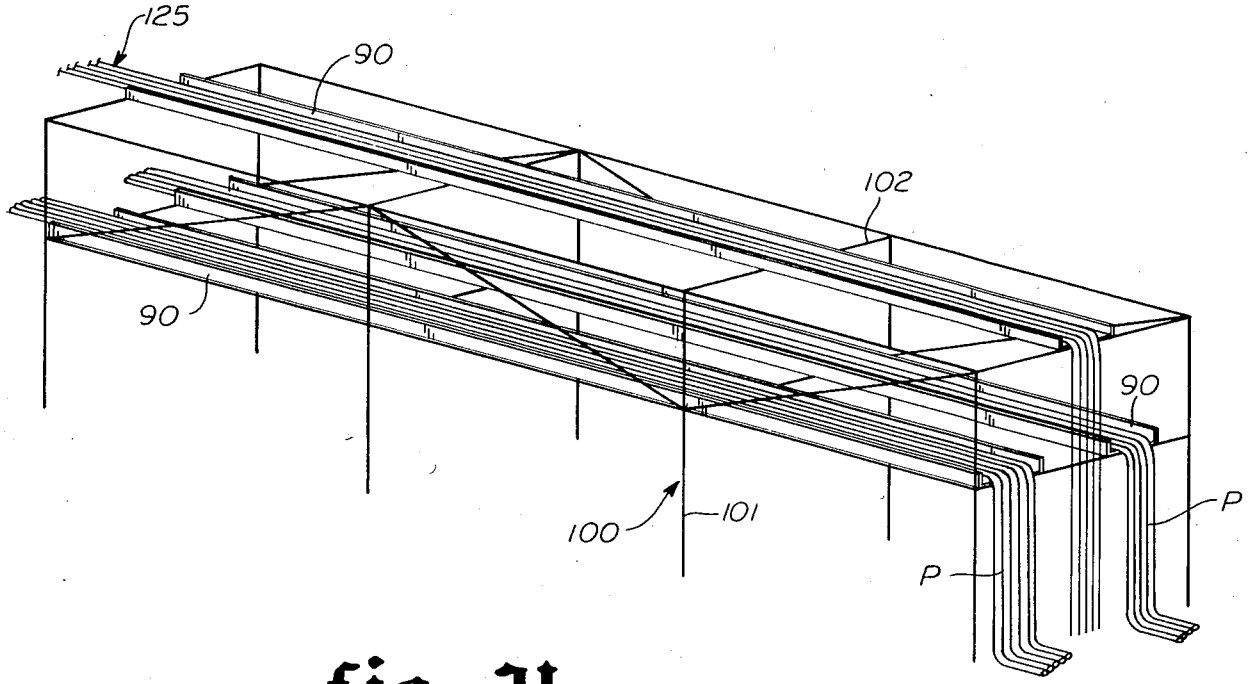
FIG. 21 illustrates the use of the present invention as a cable or pipetray in an industrial application.

FIG. 21 illustrates the present invention employed as a cable or pipe tray to support cables or pipes. In industrial applications, it is not uncommon to provide a generally U-shaped cable tray such as that illustrated at 90 to support a plurality of cables or pipes, which tray 90 is in turn carried on the structural arrangement represented generally by the numeral 100 including the vertical columns or braces 101 and suitable horizontal beams or braces 102 as desired. The trays may take any desired configuration, and in some instances may act merely as a support for the plurality of pipes or cables represented generally at 125, and in other situations, the present invention may be provided to form an enclosure to box in the plurality of pipes or cables carried on the structure 100. In this situation, the present invention is formed in generally a U-shape to function as a cable or pipe tray.

I am not fully able to explain why the panel of the present invention functions quite satisfactorily as a fire protection. However, not only does it function quite well, but it substantially reduces the weight heretofore involved in fireproofing members.

For example, with an ordinary 10W49 structural member 10' long with 3" of concrete surrounding it to provide fire protection, the weight is approximately 1½ tons; however, with the present invention, the weight of the structural member and the fireproofing arrangement employed as disclosed herein is only 600 to 700 pounds. This invention greatly reduces the weight required to fireproof, and thus reduces initial cost of structures and other installations where it is to be employed.

The foregoing disclosure and description of the invention are illustrative and explanatory thereof, and various changes in the size, shape and materials as well as in the details of the illustrated construction may be made without departing form the spirit of the invention.

I claim:

1. A fire protection arrangement comprising:

a. cementitious panel means, said cementitious panel means having spaced inner and outer surfaces defining longitudinally extending cavities connected by edge surfaces;

b. film means lining said longitudinally extending cavities within said panel means, said cavities being laterally spaced from each other and spaced from said inner, outer and edge surfaces of said panel means;

c. expanded silicious volcanic rock substantially filling said cavities; and d. said film meansfurther closing off the ends of said cavities.

2. The arrangement of claim 1 wherein the combined volume of said expanded silicious volcanic rock within the cavities is within the range of 25% to 45% by volume of the cementitious panel.

3. The arrangement of claim 1 for structural columns and beam members having flanges and a web extending between said flanges and wherein said panel means is positioned on the member parallel to the web and parallel to the flanges to enclose the member with the width of said panel means parallel with the web being approximately the distance between the outer surfaces of the flanges plus two times the thickness of said panel means parallel with the flange and the width of said panel means parallel with the flange being at least approximately one-quarter inch less than the width of the flange to form a clearance between the panel means parallel with the flange and the overlying portion of the panel means parallel with the web.

4. The arrangement of claim 1 wherein 10–40 percent of silica is combined with the cement.

5. The arrangement of claim 3 wherein spun ceramic fiber is positioned in the clearance between the panel means parallel with the column web and the panel means parallel with the column flange.

6. The arrangement of claim 3 wherein the combined total volume of the expanded lightweight inert granular material within the cavities is within the range of 25% to 45% by volume of the cementitious panel.

7. The arrangement of claim 1 for structural columns and beam members having a web extending between flanges and wherein said panel means is positioned on the member parallel to the web and parallel to the flanges to enclose the member with the width of said panel means parallel with the web being approximately the distance between the outer surfaces of the flanges plus two times the thickness of said panel means parallel with the flange and the width of said panel means parallel with the flange being approximately the width of the column flange.

8. The arrangement of claim 7 wherein the thickness of said cementitious panel means is approximately $1\frac{1}{8}$ inches to approximately $2\frac{1}{8}$ inches and the weight of said cementitious panel means is within the range of approximately 12 to 40 pounds.

9. The arrangement of claim 7 wherein flexible caulking compound is applied along said abutting panel means.

10. The arrangement of claim 7 wherein the combined total volume of the expanded lightweight inert granular material within the cavities is within the range of 25% to 45% by volume of the cementitious panel.

11. The arrangement of claims 1 or 7 wherein said film means is waterproof material.

12. The arrangement of claims 1 or 7 wherein said film means is waterproof material having a wall thickness in the range of approximately 18 to approximately 80 mils.

13. The arrangement of claim 1 or 7 wherein said film means is waterproof, reinforced material having a wall thickness in the range of approximately 35 to approximately 80 mils.

14. The arrangement of claims 1 or 3 or 4 wherein said film means is waterproof and has a thickness of approximately 15 to 25 mils.

15. The arrangement of claim 1 wherein said film means is waterproof and has a thickness of approximately 15 to 80 mils.

16. A method of positioning fire protection panels on a metal member to enclose it comprising the steps of:

a. removing mill scale and rust from the metal member at predetermined positions;
b. temporarily securing the panels in position around the member and in the end to end relation to enclose the member;
c. drilling holes through the panels at predetermined locations;
d. inserting a metal stud through the panel hole to contact the member at one of said predetermined positions from which mill scale and rust have been removed;
e. welding the stud to the member at said contacted predetermined position so that the end of said stud projects outwardly beyond the panel surface; and
f. securing the panels to the stud projecting therethrough to enclose the member within the panels.

17. The method of claim 16 wherein the step of securing includes:

a. placing a self-locking retainer ring on the projecting stud end; and
b. positioning a nut on the projecting stud end over the retainer ring.

18. The method of claim 17 wherein the step of securing includes:

a. wrapping and locking a metal band with holes therein over the joint formed between the ends of the panels that enclose the member prior to inserting and welding the studs to the member;
b. placing a self-locking retainer ring on the projecting stud over the band; and
c. positioning a nut on the projecting stud end over the retainer ring.

19. A method of positioning fire protection panels on a metal member to enclose it comprising the steps of:

a. temporarily securing the panels in position around the member and in end to end relation to enclose the member;
b. drilling holes through the panels at predetermined locations;
c. inserting a metal stud through the panel hole to contact the member;
d. welding the stud to the member at said contacted predetermined position so that the end of said stud projects outwardly beyond the panel surface; and
e. securing the panels to the stud projecting therethrough to enclose the member within the panels.

* * * * *